US012495887B2

(12) United States Patent
Zheng et al.

(10) Patent No.: US 12,495,887 B2
(45) Date of Patent: Dec. 16, 2025

(54) FOLDING HAMMOCK

(71) Applicants: Tianxia Zheng, Shanghai (CN); Shiping Zheng, Hong Kong (CN)

(72) Inventors: Tianxia Zheng, Shanghai (CN); Shiping Zheng, Hong Kong (CN)

( * ) Notice: Subject to any disclaimer, the term of this patent is extended or adjusted under 35 U.S.C. 154(b) by 149 days.

(21) Appl. No.: 18/388,969

(22) Filed: Nov. 13, 2023

(65) Prior Publication Data

US 2025/0151884 A1 May 15, 2025

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 4/08
See application file for complete search history.

(56) References Cited

U.S. PATENT DOCUMENTS 381,025 A * 4/1888 Parmelee ..... A45F 3/24 135/96
5,392,476 A * 2/1995 Williams ..... A45F 3/24 5/127
5,659,907 A * 8/1997 Huang ..... A45F 3/24 5/120
6,402,230 B1 * 6/2002 Tang ..... A47C 7/383 297/16.2
7,895,686 B1 * 3/2011 Chen ..... A47C 17/64 5/120
2004/0205893 A1 * 10/2004 Chen ..... A45F 3/24 5/127
2006/0282948 A1 * 12/2006 Deng ..... A45F 3/24 5/127
2007/0079442 A1 * 4/2007 Stoll ..... A45F 3/24 5/120
2009/0056014 A1 * 3/2009 Lee ..... A45F 3/24 5/129
2010/0287700 A1 * 11/2010 Reeb ..... A45F 3/24 5/120
2011/0231992 A1 * 9/2011 Bernat ..... A45F 3/24 5/127
2014/0259395 A1 * 9/2014 Yang ..... A45F 3/24 5/129
2015/0173495 A1 * 6/2015 Meillan ..... A45F 3/24 248/65
2024/0172861 A1 * 5/2024 Yang ..... A45F 3/22

FOREIGN PATENT DOCUMENTS

CN 212185600 U 12/2020

* cited by examiner

*Primary Examiner* — George Sun
(74) *Attorney, Agent, or Firm* — Arno T. Naeckel

(57) ABSTRACT

A folding hammock, comprising a bracket and a flexible bed surface; The bracket includes landing rod groups and support rod groups on both sides, as well as associated rod groups on both sides; The support rod group is set at both ends of the landing rod group, which includes the main support rod and the auxiliary support rod. The auxiliary support rod is set on the inner side of the main support rod and is associated with the landing rod group through the clamping component at the end. It opens in place and forms a triangular structure with the local landing rods in the landing rod group, achieving stable support.

7 Claims, 5 Drawing Sheets

FOLDING HAMMOCK

FIELD OF THE INVENTION

The present invention belongs to the field of leisure goods, in particular to a folding hammock.

TECHNICAL BACKGROUND

A hammock is a common outdoor leisure item, which can be hung directly on a fixed object without a bracket; The other type comes with a foldable bracket that can be supported on flat ground; On this basis, there are two types of suspension points: double suspension points and single suspension points at both ends. The plan with dual suspension points at both ends of the built-in bracket and flexible bed surface is not only convenient to use but also relatively safe, and is widely popular among the public.

For example: CN202020271476.X, a foldable hammock is disclosed, which includes a bed surface and a bed frame. The bed surface is arranged on the bed frame, and the bed frame includes two sets of upright poles arranged in pairs, two sets of side cross connecting rod groups arranged in parallel intervals, and two sets of middle cross connecting rod groups arranged in parallel intervals; Each group of side cross connecting rod groups can be pivotally connected to adjacent two upright rods, and each group of side cross connecting rod groups includes two side connecting rods that are pivotally connected together in the middle. The side connecting rods include a lower long rod and an upper short rod that can be pivotally connected together at the adjacent ends. A middle pivotable connecting piece is pivotally connected between the two lower long rods of each group of side cross connecting rod groups below the connection point of the two lower long rods; The two upper endpoints of the cross connecting rod group in each group can be pivotally connected to the connection between the two opposite long rods and the upper short rods, and the two lower endpoints of the cross connecting rod group in each group can be pivotally connected to the lower part of the bed frame. In this scheme, the lower end of the vertical pole used to suspend the bed surface directly touches the ground at both ends, effectively guiding the force into the ground. The internal force bearing at the top of the vertical pole is supported by the connecting rod groups on both sides. In order to achieve folding, the side connecting rod group is connected by a long rod and a short rod, resulting in insufficient stability of the support.

How to provide a more reasonable technical solution becomes the research object of the present invention.

SUMMARY OF THE INVENTION

The purpose of the present invention is to design a foldable hammock with two side support rod groups that can directly guide the force into the ground.

The technical solution of the present invention is implemented as follows:

A folding hammock, comprising a bracket and a flexible bed surface supported by the bracket, characterized in that the bracket comprises a landing rod group and a support rod group on both sides, as well as an associated rod group related to the support rod groups on both sides.

The grounding rod group includes two grounding rods that are cross hinged together, with the hinge points of the two grounding rods located above the center point of the rod. The hinge points divide the upper shorter support section and the lower longer and end landing section, and a clamping component is set between the end of the open support section and the landing section of the other grounding rod, forming an association constraint between the two grounding rods.

The support rod group is arranged at both ends of the landing rod group, including a main support rod and a auxiliary support rod. The lower end of the main support rod is hinged at the end of the landing section of the landing rod, and the upper end is suspended to hang the flexible bed surface; The upper end of the auxiliary support rod is hinged in the middle of the main support rod, and the lower end is hinged in the end of the support section of the other landing rod.

The associated rod group comprises two cross hinged rods in the middle, with the lower ends of the two rods correspondingly hinged at the lower ends of the main support rods on both sides, and the upper ends correspondingly hinged at the middle of the auxiliary support rods on both sides.

Furthermore, the clamping component includes an upper plastic component and a lower plastic component, wherein the upper plastic component is horizontally formed with a blind hole for inserting and riveting the end of the landing rod support section, and the lower end surface is formed with a downward facing tenon; The lower plastic part is horizontally formed with a through hole for the landing section of the ground rod to pass through, an upper end surface is formed with a slot for the tenon to be inserted and clamped, and the lower end surface is formed with a landing flat bottom that can be stably supported on the ground.

Furthermore, the upper plastic part in the clamping component is also formed with a hinge groove on one side of the blind hole to hinge the auxiliary support rod, and the upper end of the landing rod support section, the end of the auxiliary support rod, and the upper plastic part are riveted together with a rivet, allowing the auxiliary support rod to swing around the rivet; The through holes and card slots on the lower plastic part of the clamping component are misaligned on both sides. The through holes are located below the front projection of the hinge groove, the card slot is located below the front projection of the blind hole, and the flat bottom of the ground is located directly below the through hole. A support foot that can land on one side of the corresponding card slot is also provided.

Furthermore, a storage groove is formed above the through-hole of the lower plastic part in the clamping component, and a storage groove is set on both sides of the groove wall, and the tenon and the storage groove are in a wedge-shaped fit.

Furthermore, a triangular seat is arranged at the hinge joint between the middle of the main support rod and the end of the auxiliary support rod, and a right angle seat is arranged at the hinge joint between the end of the main support rod and the end of the landing rod. With the help of the triangular seat, right angle seat, and clamping component, the auxiliary support rod, the main support rod, and the landing rod are kept in the same plane, and partially opened to form a triangular structure.

Furthermore, both ends of the flexible bed surface are sewn with fabric covers, and a tension rod is threaded through the fabric cover. The two ends of the tension rod are hung with hanging chains, which are hung on the hanging plastic parts at the top of the main support rod.

Furthermore, the hanging plastic component is formed into a rod sleeve that can be fixed at the end of the main support rod, and a support ring platform is extended along the lower edge of the rod sleeve. The area of the support ring platform is larger than the area of the hanging ring at the end of the hanging chain.

The present invention has the characteristics of unique concept, reasonable structure, and smooth opening and folding; Especially, the auxiliary support rod is installed on the inner side of the main support rod, which can effectively solve the problem of load bearing and retraction of the hammock, and can also guide the force into the ground through the clamping component to maintain the stability of the bracket; The separation and lifting of the upper plastic part in the clamping component can quickly fold the bracket into bundles, making it small and easy to carry and store.

BRIEF DESCRIPTION OF THE DRAWINGS

Similar reference characters denote corresponding features consistently throughout the attached drawings. Namely, in the drawings the following reference numbers refer to the following part.

Similar reference characters denote corresponding features consistently throughout the attached drawings. Namely, in the drawings the following reference numbers refer to the following part.

Figure 1:
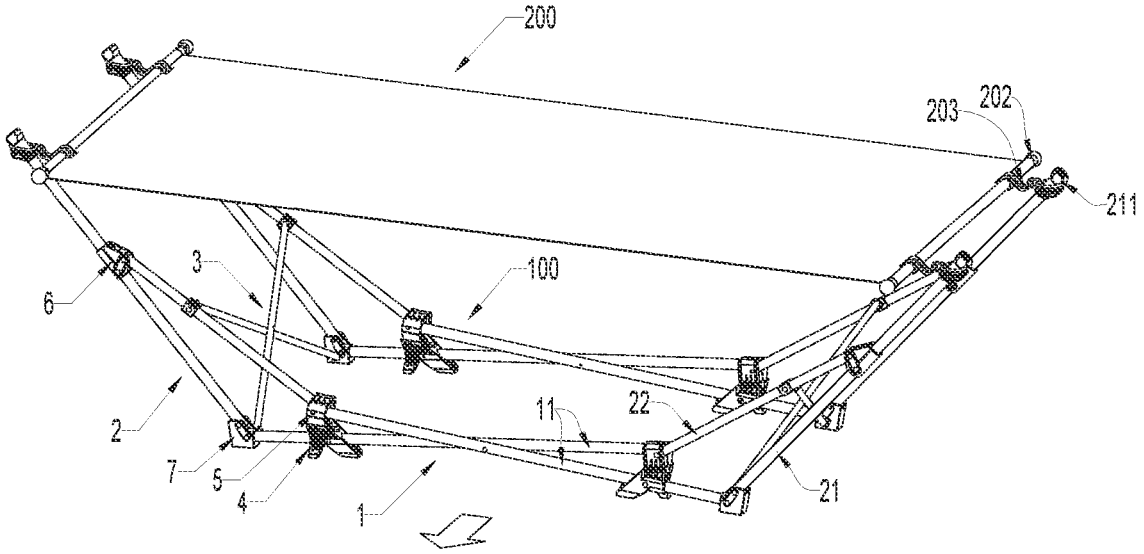
FIG. 1 shows a schematic diagram of a folding hammock.

100—bracket;
1—Landing rod group;
11—Landing rod;
111—Shorter Support section;
112—Longer support section;
12—Hinge point;
2—Support rod group;
21—Main support rod;
211—Hanging plastic section;
212—Support ring platform;
22—Auxiliary support rod;
3—Associated rod group;
31—Crossed rods;
4—Clamping components;
41—Upper plastic parts;
411—blind hole;
412—tenon;
413—Hinged groove;
42—Lower plastic parts;
421—through-hole;
422—Card slot;
423—landing flat bottom;
424—Support foot;
425—Storage groove;
5—Rivets;
6—Triangle seat;
7—Right angle seat;
200—Flexible bed surface;
201—Cloth cover;
202—Tensioning rod;
203—Chain hanging;
204—Lifting ring.

DETAILED DESCRIPTION

Referring to FIGS. 1 to 11, the folding hammock includes a support 100 and a flexible bed surface 200, which can be hung on the support 100 to form a usable hammock.

Figure 7:
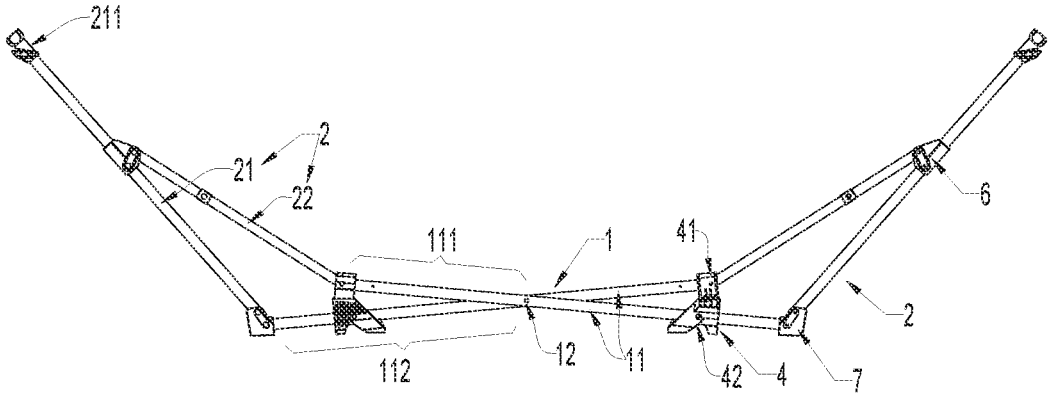
FIG. 7 shows a schematic diagram of the single side open state of the folding hammock bracket.

Support 100, including landing rod group 1 and support rod group 2 on both sides, as well as associated rod group 3 related to the support rod groups on both sides; The arrows in FIGS. 1, 2, and 4 indicate the side of the hammock. Among them:

The landing rod group 1 includes two cross hinged landing rods 11, with the hinge point 12 of the two landing rods located above the center point of the rod. The hinge point 12 divides the upper shorter support section 111 and the lower longer and end landing section 112, as shown in FIG. 7; A clamping component 4 is arranged between the end of the open support section 111 and the landing section 112 of another landing rod, forming an associated constraint between the two landing rods 11; That is to say, the ground rod group 1 is opened in place, and the end of the support section 111 is clamped and constrained with the landing section 112, and the landing support point is added with the help of this clamping component.

Support rod group 2 is arranged at both ends of landing rod group 1, which includes main support rod 21 and auxiliary support rod 22. The lower end of main support rod 21 is hinged at the end of landing section 112 of the landing rod, and the upper end is suspended to hang flexible bed surface 200; The upper end of the auxiliary support rod 22 is hinged to the middle of the main support rod 21, and the lower end is hinged to the end of the support section of another landing rod 11. More specifically, it is hinged to the clamping component 4 at the end of the support section. In this structure, the auxiliary support rod 22 is located on the inner side of the main support rod 21, which can prevent the main support rod 21 from bearing weight and force and then retract inward. With the help of the auxiliary support rod 22, a portion of the force is transmitted to the landing rod group 1 through the clamping component 4 and introduced into the ground, as shown in FIG. 7.

Figure 2:
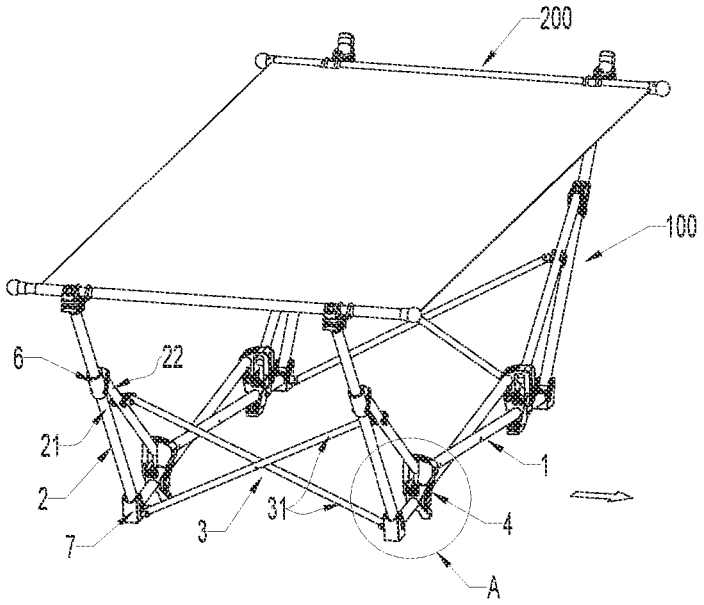
FIG. 2 shows a schematic diagram of the second perspective of the folding hammock.
Figure 3:
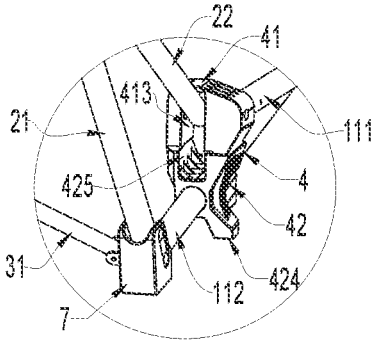
FIG. 3 shows a partially enlarged schematic diagram of A in FIG. 2.
Figure 4:
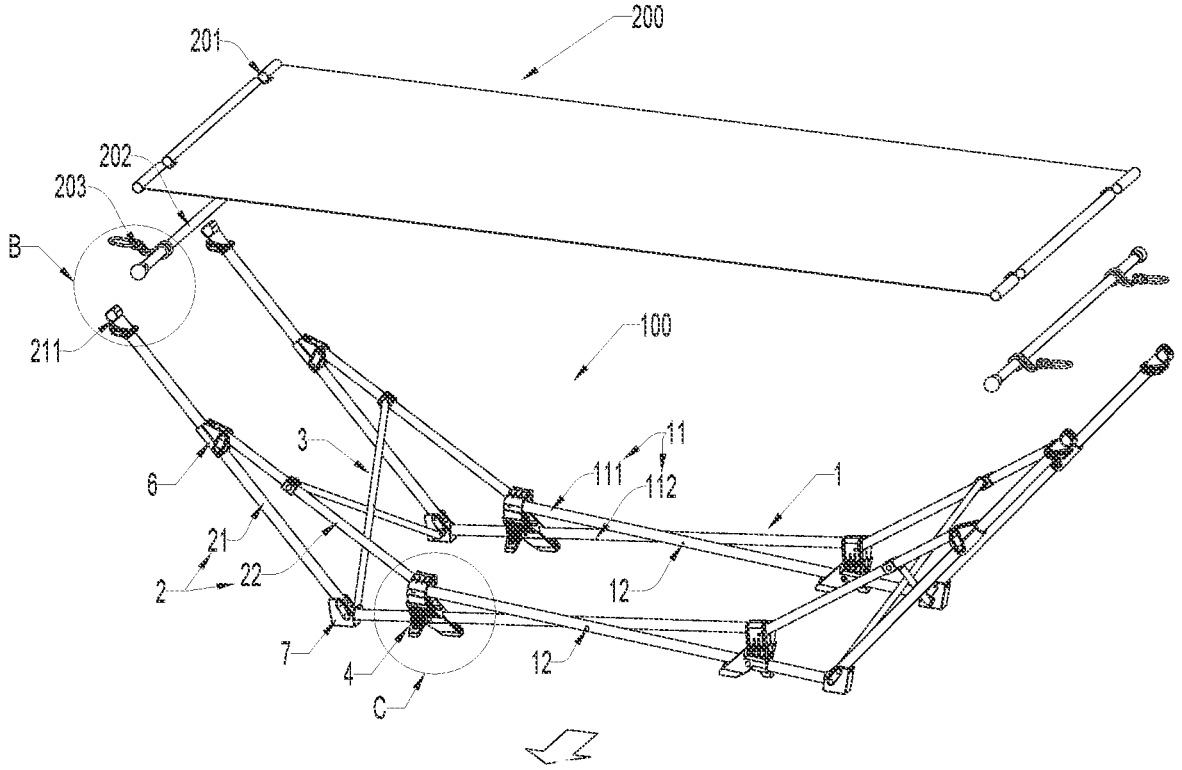
FIG. 4 shows the breakdown diagram of a folding hammock.
Figure 5:
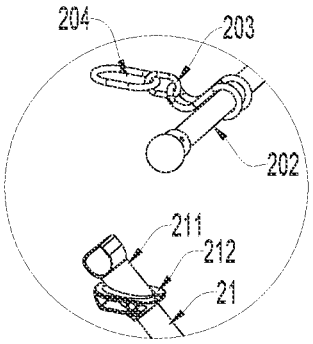
FIG. 5 shows a partially enlarged schematic diagram of B in FIG. 4.

Associated rod group 3, including two cross hinged rods 31 in the middle. The lower ends of the two rods 31 are correspondingly hinged at the lower ends of the main support rods 21 on both sides, and the upper ends are correspondingly hinged at the middle of the auxiliary support rods 22 on both sides. Realize the association between the two support rod groups on both sides, and maintain the open state of the constraint bracket, as well as provide action associations for the opening and folding processes, as shown in FIG. 1, FIG. 2, and FIG. 4.

The clamping component 4 includes an upper plastic component 41 and a lower plastic component 42. The upper plastic component 41 is horizontally formed with a blind hole 411 for inserting and riveting the end of the ground rod support section 111, and the lower end surface is formed with a downward facing tenon 412; More specifically, the upper plastic part is also formed with a hinge groove 413 on one side of the blind hole 411 to hinge the auxiliary support rod. The upper end of the landing rod support section 111, the end of the auxiliary support rod 22, and the upper plastic part 41 are riveted together with a rivet 5, and the auxiliary support rod 22 is allowed to swing around the rivet 5 to complete the folding action, as shown in FIGS. 1, 3, 6, and 11.

Figure 6:
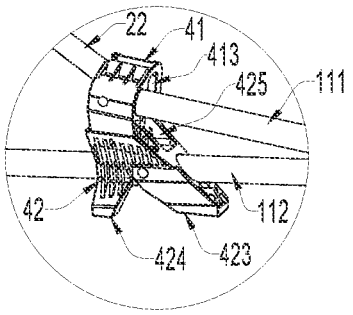
FIG. 6 shows a partially enlarged schematic diagram of C in FIG. 4.
Figure 11:
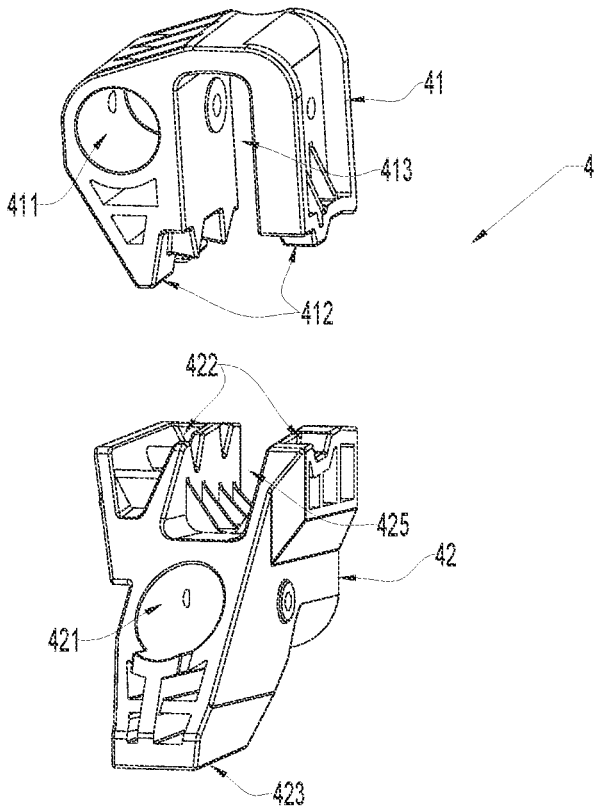
FIG. 11 shows a schematic diagram of the separated states of the clamping components.

The lower plastic part 42 is horizontally formed with a through hole 421 for the landing section 112 of the ground rod to pass through, a slot 422 for the insertion and engagement of the convex tenon 412 on the upper end surface, and a landing flat bottom 423 that can be stably supported on the ground is formed on the lower end surface; Furthermore, the through holes 421 and card slots 422 on the lower plastic part are misaligned on both sides. The through holes 421 are located below the forward projection of the hinge slot 412 on the upper plastic part, the card slots 422 are located below the forward projection of the blind hole 411, and the landing flat bottom 423 is located directly below the through hole 421. A support foot 424 that can land is also set on one side of the corresponding card slot 422, which together forms a landing support and increases the landing area and range, as shown in FIGS. 6 and 11.

Figure 10:
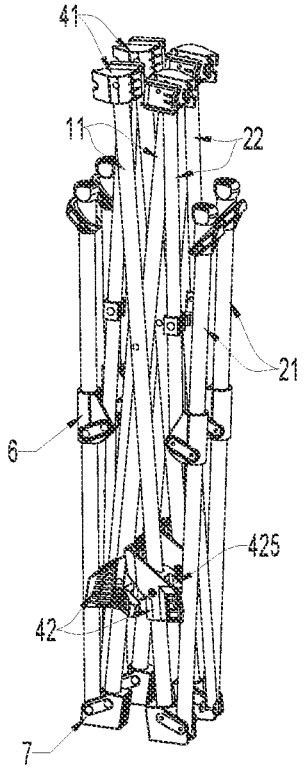
FIG. 10 shows a schematic diagram of the folding state of the folding hammock bracket.

Due to the design gap between the end of the support section 111 and the landing section 112 of the other one after the two landing rods 11 are opened, the lower plastic part 42 can be appropriately raised, and the raised part cannot occupy the folded space. Therefore, a storage groove 425 is formed above the through-hole of the lower plastic part 42, and card grooves 422 are set on both sides of the groove walls of the storage groove 425 to achieve balanced support on both sides; The tenon 412 and slot 422 are both wedge-shaped and can be easily inserted during the opening process, with a certain tolerance. As shown in FIG. 10, the bracket is folded in place, and the storage slot 425 can be accessed by the main support rod 21 on the same side to avoid obstructing the assembly and folding of the rod components.

Furthermore, a triangular seat 6 is arranged at the hinge joint between the middle of the main support rod 21 and the end of the auxiliary support rod 22, and a right angle seat 7 is arranged at the hinge joint between the end of the main support rod 21 and the end of the landing rod 11. With the help of the triangular seat 6, the right angle seat 7, and the clamping component 4, the landing section 112 of the auxiliary support rod 22, the main support rod 21, and the landing rod 112 are kept in the same plane, opened in place to form a triangular structure, forming a stable support. The load-bearing force at the upper end of the main support rod 21 can be directly introduced into the ground through the auxiliary support rod 22 and the clamping component 4 in the same plane, in collaboration with the right angle seat 7 at the end of the main support rod, forming a common landing support. The above triangular seat 6 and right angle seat 7 are only for naming purposes and are not limited to their specific shapes.

The flexible bed surface 200 of this hammock is a four corner suspension structure, and there are no flipping defects during use. More specifically, the flexible bed surface 200 is sewn with fabric sleeves 201 at both ends, and a tension rod 202 is threaded through the fabric sleeve. The two ends of the tension rod 202 are hung with hanging chains 203, which are hung on the hanging plastic part 211 at the top of the main support rod 21 with the help of hanging chains 203; The hanging plastic component 211 is formed into a rod sleeve that can be fixed at the end of the main support rod, and a supporting ring platform 212 is extended along the lower edge of the rod sleeve. The area of the supporting ring platform 212 is larger than the area of the hanging ring 204 at the end of the hanging chain 203, forming a suspension force limiting effect. When folding, the flexible bed surface 200 can be wrapped and folded up according to the tension rods 202 at both ends, and loaded into a storage bag together with the folded bracket 100.

Figure 8:
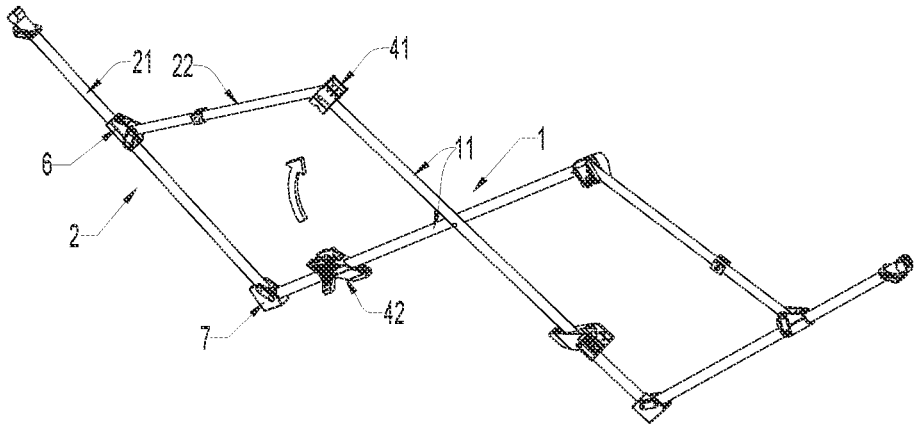
FIG. 8 shows a schematic diagram of the folding process of the folding hammock bracket on one side.
Figure 9:
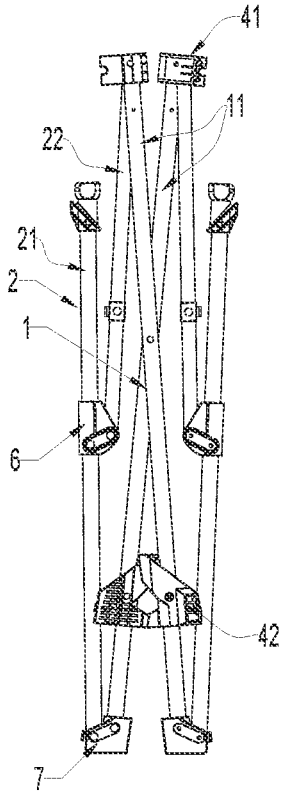
FIG. 9 shows a schematic diagram of the folding state of the folding hammock bracket on one side.

During the opening and folding process of bracket 100, as shown in FIGS. 7, 8, and 9, the landing rod group 1 and the support rod group 2 form a double quadrilateral structure. When opened, both hands open the upper end of the main support rod 21 outward, and the landing rod group 1 synchronously drives it to unfold. From the state in FIG. 9 to the state in FIG. 8, continue to manually press down on the upper plastic part 41 to flip the auxiliary support rod 22 downward over the interference point, until the upper plastic part 41 and the lower plastic part 42 snap in place, as shown in the state in FIG. 7, Then hang the flexible bed surface 200; When folding, it is necessary to lift the upper plastic part 41 to flip the auxiliary support rod 22 and close the main support rod 21, etc.

What is claimed is:

1. A foldable hammock, comprising:

a bracket 100 and a flexible bed surface 200 supported by the bracket, wherein the bracket comprises a landing rod group 1 and a support rod group 2 on each side, as well as an associated rod group 3 related to the support rod groups 2 on both ends of the landing rod groups 1;

wherein each landing rod group 1 includes two landing rods 11 that are cross hinged together at a hinge point 12, with the hinge point 12 of the two landing rods 11 located near the center point of the landing rods 11 dividing the landing rods 11 into an upper shorter support section 111 and a lower longer support section 112, wherein further a clamping component 4 is set between end of the shorter support sections 111 and the longer support sections 112 of the other landing rod, thereby forming an association constraint between the two landing rods 11 of each landing rod group 1;

wherein a support rod group 2 is arranged at both ends of the landing rod groups 1, including a main support rod 21 and an auxiliary support rod 22, the lower end of the main support rod 21 being hinged at the distal end of the longer end section of the landing rod, the upper end suspending the flexible bed surface, wherein further an upper end of each auxiliary support rod 22 is hinged to each main support rod 21, and the lower end is hinged in a clamping component 4;

wherein further, each of the associated rod groups 3 comprises two crossed rods 31 with the lower ends of each of the two crossed rods 31 correspondingly hinged at the lower ends of the main support rod groups 2 on both sides and the upper ends are hinged to the other auxiliary support rods 22.

2. The folding hammock according to claim 1, wherein each clamping component 4 comprises an upper plastic part 41 and a lower plastic part 42, wherein the upper plastic part 41 is formed horizontally with a blind hole 411 for inserting a shorter end of a landing rod 11, and a lower end surface formed with a downward facing tenon 412, wherein, the lower plastic part 42 is horizontally formed with a through hole 421 for another landing rod to pass through, an upper end surface is formed with a card slot 422 for the tenon to be inserted and clamped, wherein further, the clamping component 4 is formed with a landing flat bottom 423.

3. The folding hammock according to claim 2 wherein the upper plastic part 41 in the clamping component 4 is also formed with a hinge groove 413 on one side of the blind hole 411 to hingedly connect the auxiliary support rod 22 to an upper end of the landing rod support section 111, wherein, the upper plastic part 41 is riveted together with a rivet 5 such that the auxiliary support rod 22 is allowed to swing around the rivet, wherein further, the through holes 421 and card slots 422 on the lower plastic part of the clamping components 4 are misaligned on both sides, the through holes 421 being located below the front projection of the hinge groove 413 and the card slots 422 being located below the front projection of the blind holes, 411 and the flat bottoms 423 being located directly below the through holes 421.

4. The folding hammock according to claim 3, wherein a storage groove 425 is formed above the through hole 421 of the lower plastic part 42 in the clamping component 4, wherein a card slot 422 is set on both sides of a storage groove wall, and wherein further the tenons 412 and the card slots 422 are in a wedge-shaped fit.

5. The folding hammock according to claim 1, wherein a triangular seat 6 is arranged at the hinge located between the middle of the main support rod 21 and the end of the auxiliary support rod 22, wherein further a right angle seat 7 is arranged at a hinge joint between the lower end of the main support rod 21 and a longer end of a landing rod 112.

6. The folding hammock according to claim 1, wherein a flexible bed surface 200 is sewn with fabric covers at both of its ends, and a tensioning rod 202 with two ends is threaded through each of the fabric covers 201, wherein further the two ends of the tensioning rod 202 are each attached to one end of hanging chains 203, which are attached to the hanging plastic component 211 by their other end that is in turn attached at the top end of each of the main support rods 21.

7. The foldable hammock according to claim 6, wherein the hanging plastic component 211 is formed into a rod sleeve that can be fixed on the upper end of the main support rod 21—with a support ring platform 212 extended along the lower edge of the rod sleeve, wherein further the area of the support ring platform 212 is larger than the area of a hanging ring 204 at the end of the hanging chain 203.

* * * * *